US005707429A

United States Patent [19]

Lewis

[11] Patent Number: 5,707,429

[45] Date of Patent: Jan. 13, 1998

[54] IONIZING STRUCTURE FOR AMBIENT AIR TREATMENT

[75] Inventor: Keith B. Lewis, Salt Lake City, Utah

[73] Assignee: Lewis Lint Trap, Inc., Salt Lake City, Utah

[21] Appl. No.: 719,735

[22] Filed: Sep. 25, 1996

[51] Int. Cl.[6] ..... B03C 3/41

[52] U.S. Cl. ..... 96/63; 96/82; 96/88; 96/97

[58] Field of Search ..... 96/97, 82, 88, 96/83, 60–63; 361/231, 226; 95/57

[56] References Cited

U.S. PATENT DOCUMENTS

| | | | |
|---|---|---|---|
| Re. 34,346 | 8/1993 | Foster, Jr. et al. | 361/231 |
| 2,279,586 | 4/1942 | Bennett | 96/97 X |
| 3,046,716 | 7/1962 | Rodger | 96/97 |
| 3,156,847 | 11/1964 | Schweringer | 96/97 X |
| 3,624,448 | 11/1971 | Saurenman et al. | 96/82 X |
| 3,757,803 | 9/1973 | Chiang | 96/97 X |
| 3,768,258 | 10/1973 | Smith et al. | 96/97 X |
| 3,900,766 | 8/1975 | Kawada | 96/82 X |
| 3,915,672 | 10/1975 | Penney | 96/82 X |
| 4,339,782 | 7/1982 | Yu et al. | 96/97 X |
| 4,477,263 | 10/1984 | Shaver et al. | 96/97 X |
| 4,713,093 | 12/1987 | Hansson | 96/82 |
| 4,955,991 | 9/1990 | Torok et al. | 96/97 X |
| 5,435,837 | 7/1995 | Lewis et al. | 361/231 X |
| 5,474,600 | 12/1995 | Volodina et al. | 96/97 X |
| 5,484,472 | 1/1996 | Weinberg | 361/226 X |

*Primary Examiner*—Richard L. Chiesa
*Attorney, Agent, or Firm*—M. Ralph Shaffer

[57] ABSTRACT

Improved ionizing structure for ambient air treatment wherein the structure incorporates an ionizing needle directed in the direction of airflow; the needle is negatively charged to produce an electrostatic field, preferably pulsating, whereby to ionize air constituent molecules, lint, and other entrained constituents, allowing the latter simply to precipitate out of the air and fall to the ground or floor beneath; in such manner ambient air within a room enclosure, for example, is cleaned for maximizing occupant enjoyment as well as for health and other reasons.

7 Claims, 4 Drawing Sheets

IONIZING STRUCTURE FOR AMBIENT AIR TREATMENT

FIELD OF INVENTION

The present invention relates to apparatus for treating ambient air and, more particularly, provides a unique ionizing structure, constructed for the treatment of ambient air, wherein the air conditioning provided is maximized, and is performed in such a manner that, in addition to producing negative air-constituent ions, dust, lint, and other particles are also simply electrostatically charged negatively so as to drop out of the air and fall to the floor of a room, for example, in which the structure is placed.

DESCRIPTION OF PRIOR ART

Made of record is the inventor's prior United States Patent issued Jul. 25, 1995, U.S. Pat. No. 5,435,837 entitled ION GENERATION STRUCTURE IN ENVIRONMENTAL SYSTEMS. Other U.S. Patents which are known are as follows:

Re. 34,346
2,279,586
3,046,716
3,624,448
3,768,258
3,900,766
3,915,672
4,339,782
4,713,093
4,955,991
5,474,600
5,484,472

The electrostatic field produced in the inventor's prior patent is accomplished by means of a wire that is negatively charged and disposed transverse to an incoming airstream. The inventor herein has found it highly desirable and far more effective to orient the charging element such that it is in line with, i.e. coaxial with, incoming and outgoing airstream flow. Other advances and structural considerations will be pointed out hereinafter.

Some of the patent literature cited above speak of mutually spaced electrode structure for generating an electric corona discharge in air proximate the electrode structure in that a negatively charged corona electrode is disposed centrally of a conductive target electrode sleeve, the voltage between the two being applied such that a corona discharge occurs so as to produce air ions which are utilized to charge electrically particulate contaminants, liquid droplets, and the like present in the air. See for example U.S. Pat. No. 4,955,991. The problem with corona discharge equipment is that a corona discharge generates certain chemical compounds, primarily ozone and nitrogen oxide, that in moderate to high concentrations can be harmful to health. Accordingly, special precautions are taken in the prior art to process the undesired gases thus generated so as to mitigate their presence and effect. It is to be noted that the present invention avoids the generation of corona discharge and thus, does not have any target electrode which will coact with any corona discharge electrode, the two electrodes, of course, being oppositely charged.

The concept of a needle-like charging element standing alone, of course, is not new, see U.S. Pat. No. 4,339,782 (Yu et al) and U.S. Pat. No. 5,474,600 (Volodina et al). In both of these patents, however, there are included electrically conductive and charged elements circumscribing the needle electrode, this for the presumed purpose of supplying an electrical circuit as between the electrode needle and the surrounding electrode which has heretofore been presumed to be necessary to produce the air ions desired. In the present invention no such restriction is made and, in fact, is undesired, for reasons that will be hereinafter pointed out.

U.S. Pat. No. 3,900,766 (Kawada) teaches the general principle of a conventional ionizer having a central negatively charged electrode surrounded, in whole or in part, by an oppositely charged cylinder or cylindrical segment. Reliance as to electron conduction between the negatively charged central electrode and the outermost cylindrical electrode is relied upon to produce air ions. The Kawada Patent does teach that there are many types of step-up transformers that can be utilized in ionizing equipment. In the present invention a step up transformer is likewise used, and it may be the conventional multiple coil type, the auto-transformer type, a microcircuit step-up transformer, or simply a piezoelectric electrode which is described in the Kawada Patent, supra, all forms being well known in the art. Again, in the present invention there is no positively charged electrode intimately related with the negatively charged ionizing element utilized herein.

U.S. Pat. No. 3,768,258 (Smith et al) is of interest, but relates to a different field of art, namely, to exhaust ducts for automobile engines, gasoline or diesel, wherein an ion generator is employed to effect the flow of ions into the engine exhaust stream; however, in this patent the ions produced negatively charge the engine stream products for the purpose of collecting these on a downstream filter, see FIG. 3 and not needed in the present invention, which is oppositely charged. This is totally different from the present invention as below described. The other patents above recited are of more general interest.

BRIEF DESCRIPTION OF THE PRESENT INVENTION

The structure of the present invention includes a housing having an inlet filter, and also an outlet exhaust port preferably including a grid suitable for protecting against unwanted objects and hands in the ionizing area. Importantly, there is included within the device a mount comprising a riser which has fitted thereon an ionizing element holder and shield composed of nonconductive material. The ionizing element itself takes the form of a thumbtack-like element having an elongated and sharpened stem. The head of the element is received into the holder's pocket in a desired manner. The elongated element is oriented in the direction of airstream flow and serves as the ionizing element. To the head of the element is secured, as by silver solder, for example, an electrode which carries a negative charge of high magnitude, i.e., in excessive of 15,000 volts. This voltage is produced by use of a step-up transformer the input side of which is simply plugged into an AC source such as a room wall socket of 110 volts AC. Importantly, while the air intake can be provided a filter element, the air exhaust port of the unit is preferably not filtered. This is for the purpose of allowing ionized air particulates to proceed into the room interior and ionize, i.e., negatively charge, dust particles, lint, and other foreign matter as might be present in the air. It has been discovered that when the ionizing technique is used as herein described, then the foreign matter will simply become negatively charged and precipitate out, from their entrained condition, to floor level. Accordingly, in a sense then the entire room becomes the over-all ionizing chamber.

The invention is most effective when the high-magnitude negative DC voltage supplying the ionizing element is pulsating rather than of steady state value. In this way, an electrostatic field of pulsating nature emanates from the ionizing element, and particularly the tip thereof, to extend forwardly into the room interior and thus provide a means for ionizing and/or thus negatively charge the foreign elements within the room. This, it is believed, is the primary feature of the invention, which is supplemented by the air ions actually generated at the ionizing element or needle and blown forwardly by the fan or blower utilized in the unit.

Objects

Accordingly, a primary object of the present invention is to provide a new and improved ionizing structure or unit for cleaning ambient air in rooms.

A further object is to provide an improved ionizing structure for conditioning a gas stream.

An additional object is to provide a new and improved mounting structure for an ionizing element wherein the ionizing needle or element employed is free from generating noxious gases as through corona discharge, and which simply relies on the production of ionization to occur primarily beyond and forwardly of the ionizing structure.

BRIEF DESCRIPTION OF DRAWINGS

The present invention may best be understood by reference to the following description taken in connection with the accompanying drawings in which.

DETAILED DESCRIPTION OF PREFERRED EMBODIMENTS

Figure 1:
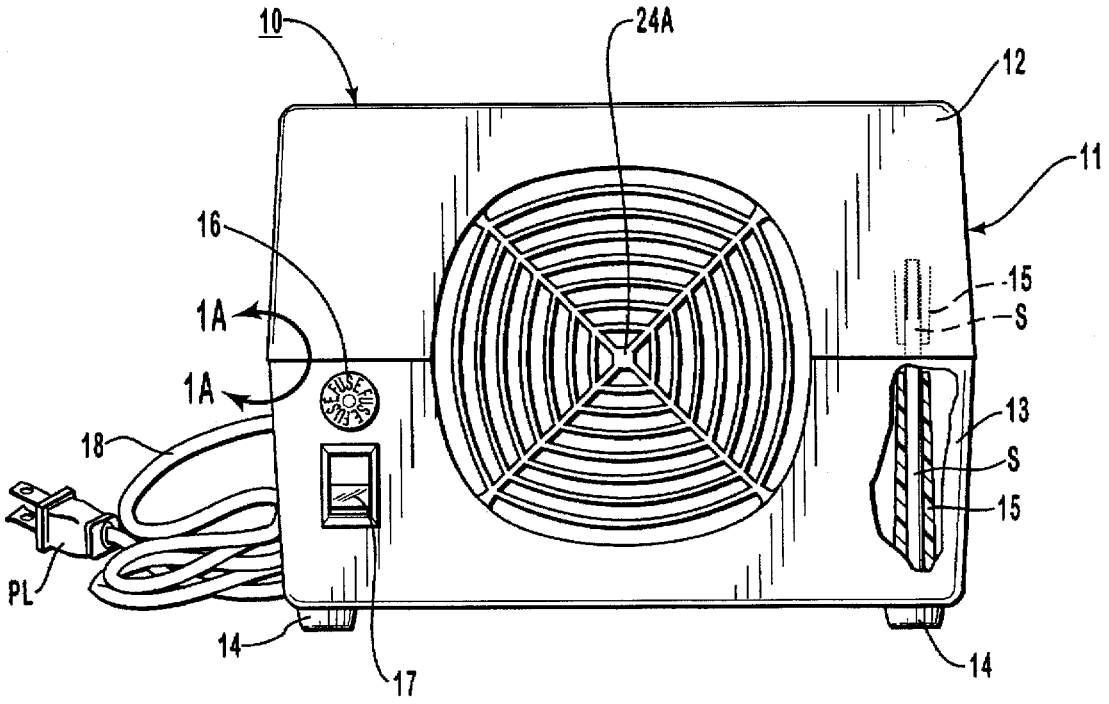
FIG. 1 is a front elevation of the unit comprising the structure of the present invention.

In FIG. 1 unit 10 includes housing 11 provided with upper housing shell 12 and lower housing shell 13. Lower housing shell 13 includes base pads 14 as indicated.

Figure 4A:
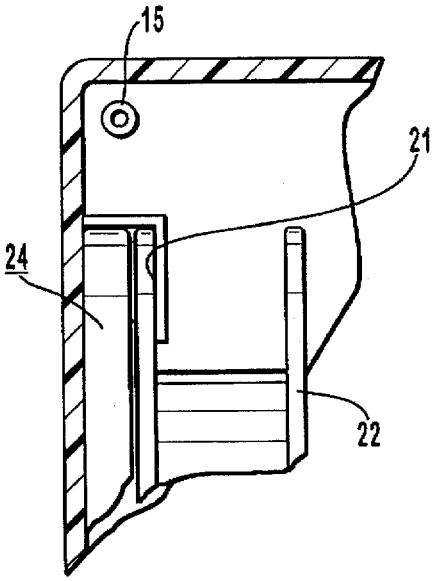
FIG. 4A is a detail of a representative, lower housing shell corner area, corresponding for example to the lower corner structure side-opposite to that shown underneath the arrows 4—4 in FIG. 4, and constitutes an enlarged fragmentary detail, partially sectioned, illustrating the pocket in which the rear flange of the blower unit provided and also the rear filter grill unit, are mounted.
Figure 4:
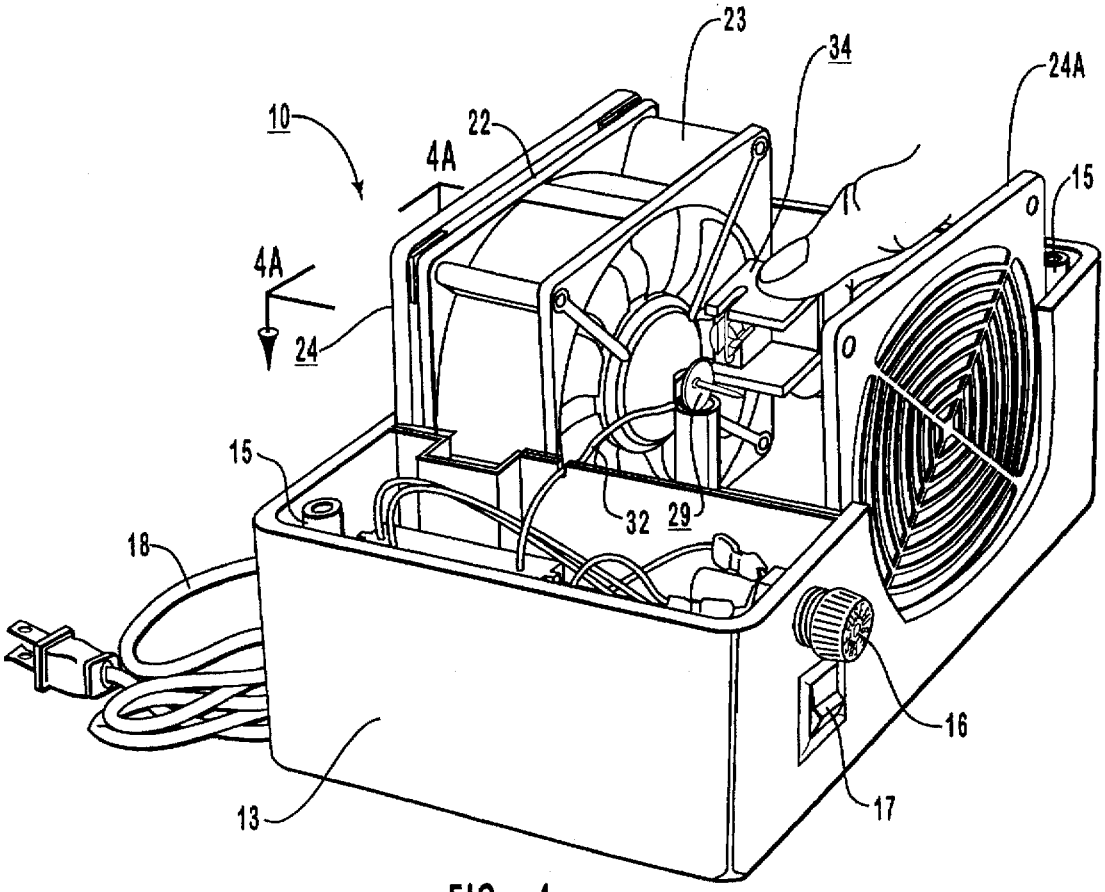
FIG. 4 is a perspective view of the unit of FIG. 1, with the upper housing shell removed, indicating one type of manual manipulation that may be used in mounting the ionizer element within the unit.

The two shells will be secured together by a series of suitable elongated screws S, which cooperate with the aligned screw receiving bosses 15 representative ones of which are seen in FIG. 4. The screw heads, not shown, may be covered by removable base pads 14 in FIG. 1. It is also seen that mounted to the lower housing shell 13 are fuse unit 16 and on/off power switch 17, which may be of conventional manufacture. A power cord 18 having socket plug PL is likewise provided.

Figure 1A:
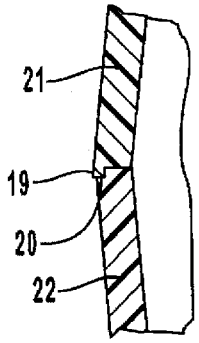
FIG. 1A is an enlarged detail taken along the arcuate line 1A—1A in FIG. 1.
Figure 6A:
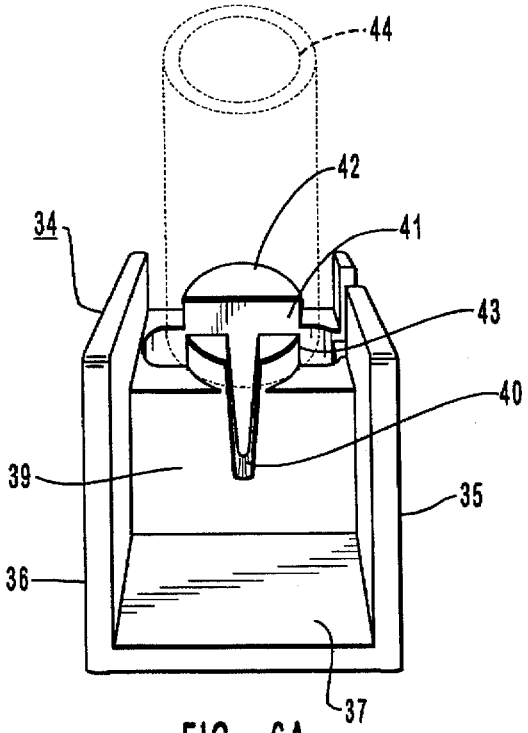
FIG. 6A is a bottom perspective view, looking rearwardly, of the cover mount 34, showing its construction details and suitability for mounting the ionizing element in an appropriate manner.

In passing it is to be noted that the two housing shells can be made to overlap, see FIG. 1A, as by the provision of a peripheral shoulder 19 which fits in peripheral recess 20. These will relate, of course, to the peripheral side walls 21 and 22 of the upper and lower housing shells 12 and 13.

Figure 2:
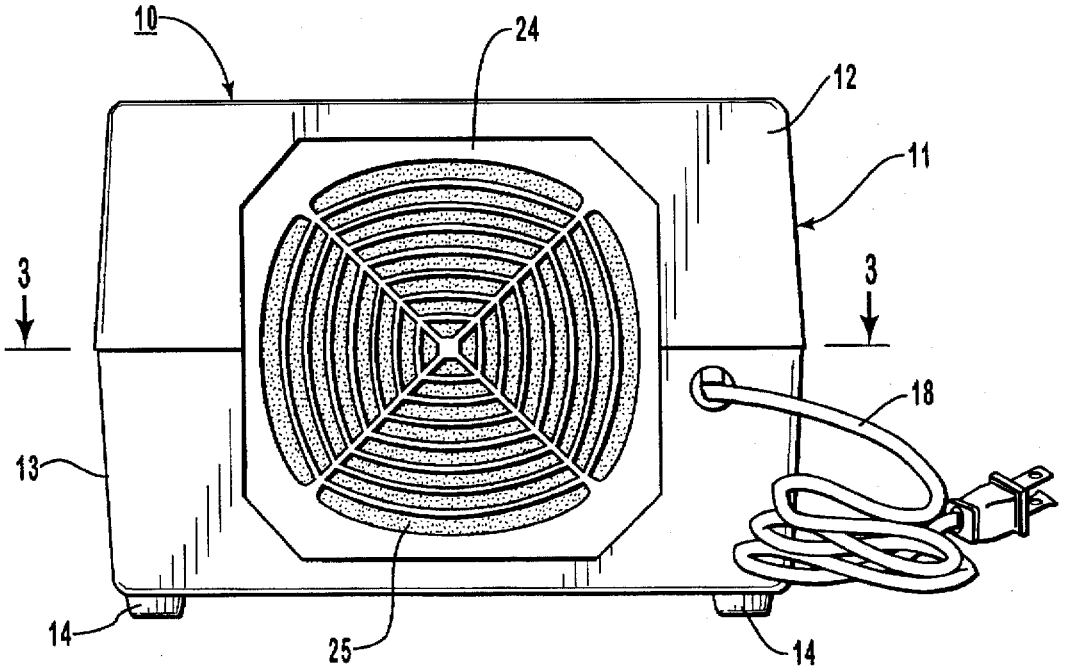
FIG. 2 is a rear view of the structure of FIG. 1.
Figure 3:
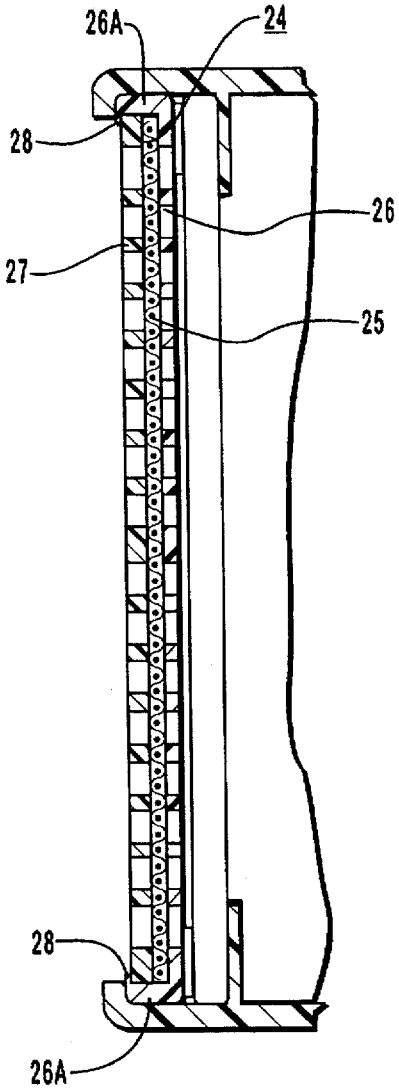
FIG. 3 is an enlarged fragmentary section taken along the line 3—3 in FIG. 2 and is rotated 90 degrees, showing in fragmentary view the structure of the rear filter grill unit and its nesting in the molded structure of the lower housing shell of the unit.

FIG. 4A illustrates that the lower housing shell may be provided with a flange-formed pocket 21 into which is seated the rear flange 22 of lower 23 and the rear filter grill unit 24 of FIG. 2. The rear filter grill unit 24, see FIG. 3, may take the form of an interior filter 25 having a perforate base support 26 and also outer grill 27. Base support 26 may include a peripheral base flange 26A having overlapping lips at 28 to receive the outermost grill 27.

Figure 5:
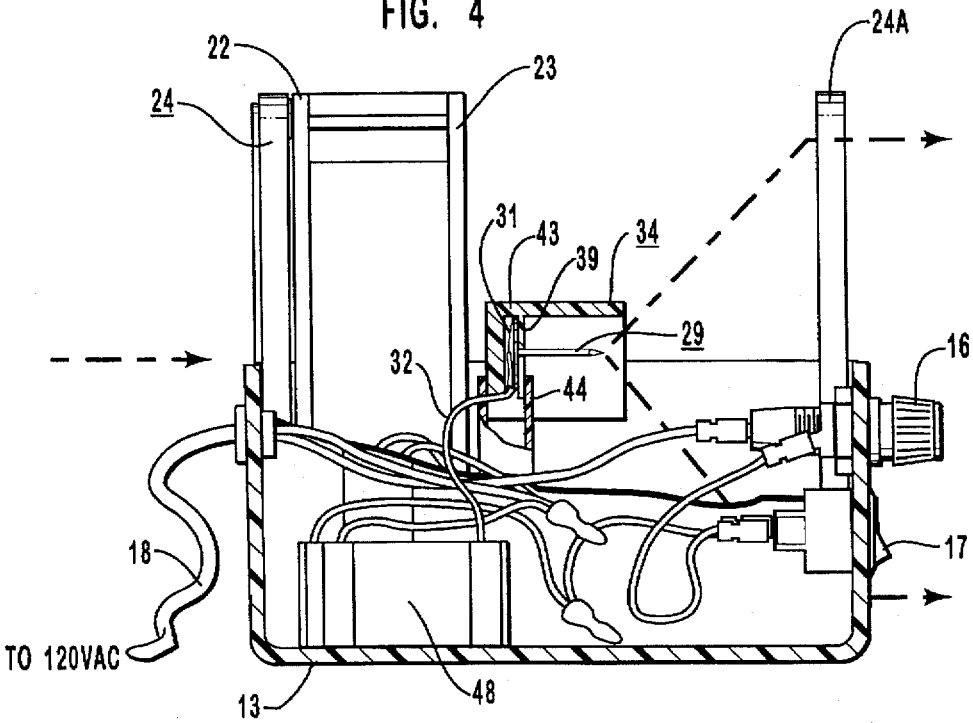
FIG. 5 is a left side elevation, the side wall being shown removed, of the structure of FIG. 4, a portion thereof being sectioned to illustrate the interior wiring and components of the structure.
Figure 6:
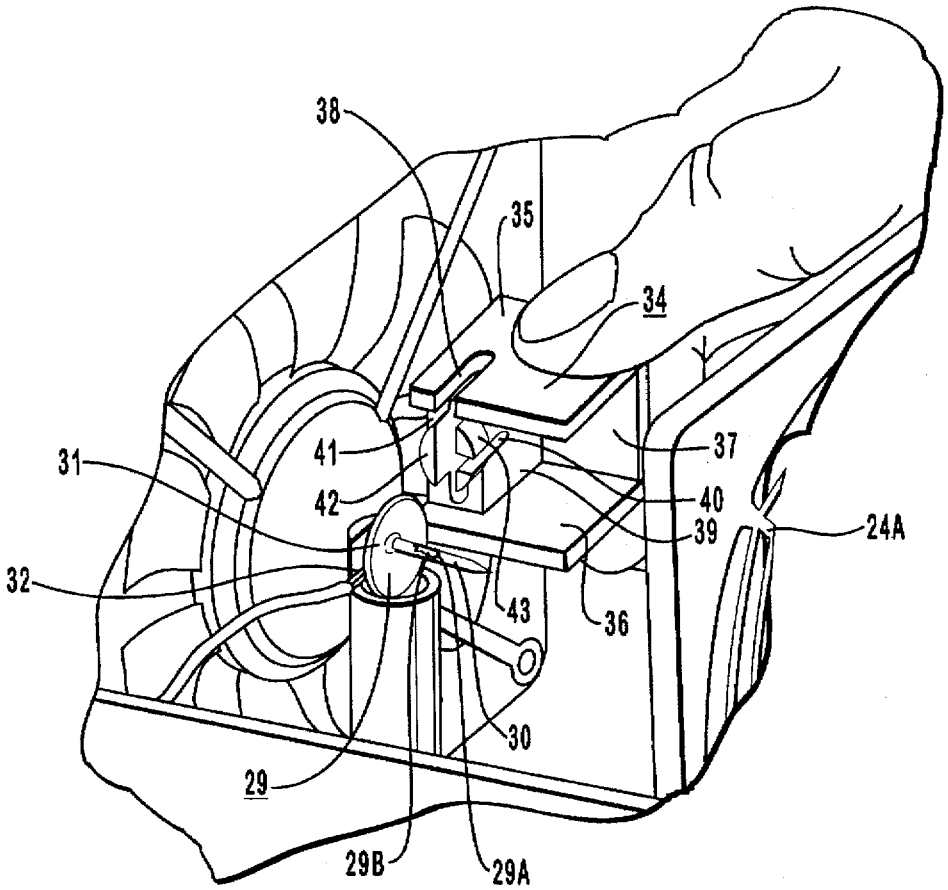
FIG. 6 is an enlarged fragmentary detail of the central portion of the structure of FIG. 4, illustrating with further clarity the cover mount employed which is used in combination with the centrally located ionizer element.

The structure of FIGS. 4, 5, and 6 deserve special consideration and will be considered together. Ionizing element 29 may take the form simply of a thumbtack formed, e.g., of a brass thumbtack element 29A having a nickle-plated coating 29B. In any event, the same has an elongated needle 30 and, integral therewith, a head 31. The ionizing element 29, composed of elements 30 and 31, may be manufactured in mass production and simply comprise the brass thumbtacks, again, which are nickel coated, by way of example. The exposed wire end of electrical lead 32 is silver soldered at 33, FIG. 7, to an outer portion of the head 31 of ionizing element 29. The tip of needle 30 is pointed so as to maximize the effect of the negative voltage potential at such tip, with the expanding, pulsating, electrostatic field produced thereby.

Cover mount 34, a support-and-shield insulative member, deserves special consideration and preferably comprises a molded plastic part which is electrically non-conductive and, indeed, is composed of insulative material. The same has opposite sides 35 and 36, FIG. 6, which are joined together at the top by top 37. Side 35 has a slot 38 which receives the connecting wire, i.e. electrical lead 32, see FIGS. 4 and 7. A partition 39 is integrally molded within the cover mount and includes a slot 40 for receiving the pin or needle 30. Importantly, the rear side 41 of the cover mount includes a depending cylindrical sector 42, and correspondingly, partition 39 includes a notched cylindrical sector 43 which is bifurcated to allow for slot 40 receiving the pin or needle 30. Accordingly, and as seen in FIG. 5, the cover mount 34 receives the ionizing element so as to admit the head 31 into pocket 43 as formed by rear partition 41 and the intermediate partition 39. The depending cylindrical sectors 42, 43 of the cover mount fit into the cylindrical interior of upstanding riser post 44. Accordingly, the ionizer element is secured in place easy and conveniently and yet rigidly by virtue of the unique design of cover mount 34 and its coaction with the ionizer element and the upstanding post 44.

The purpose for the inclusion of cover mount 34 is not only to mount in a secure manner the ionizing element but also to isolate the same against leakage to any of the grounded parts of the unit. The electrostatic field produced as shown by the dotted lines in FIG. 5 emanate outwardly into a room interior. The blower and its fan provides a forward airstream likewise proceeding in the direction of the arrows in FIG. 5.

Figure 7:
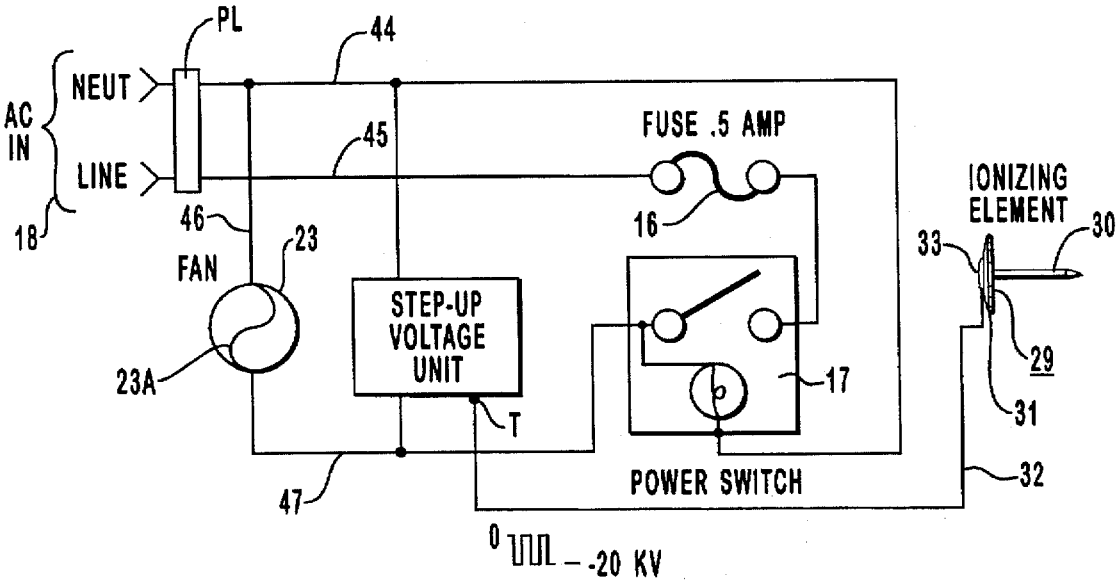
FIG. 7 is a schematic detail of a representative circuit that can be used in conjunction with the unit.

A representative electrical circuit that can be used is shown schematically in FIG. 7. Thus, power cord 18 is coupled to an alternating current voltage source such as a standard room wall socket and is provided with leads 44 and 45 which connect via fuse 16 to power switch 17 in the manner indicated. Fan leads 46 and 47 are connected as shown. Unit 48 is a voltage step-up device such as a multiple coil transformer, an auto transformer, a step-up microcircuit, or a piezoelectric voltage step-up device, as indicated, all of which are well known in the art. A negative voltage is generated at terminal T of unit 28 which preferably is pulsating and of the order of 20,000 volts. It is this voltage which is applied by lead 32 to the head of ionizing element 29.

The unit operates as follows. Power cord 18 is plugged into an AC outlet of a wall socket and, upon the manipulation of power switch 17, the blower 23 commences to operate, providing a forward stream of air drawn through the rear filter grill unit 24 and proceeding out of the front grill member 24A. Simultaneously there is produced a high negative voltage of the order of in excess of 15,000, e.g. −20,000 volts DC, and preferably pulsating, for application to ionizing element 29, FIG. 7. The head 31 of the element provides a convenient location for soldering as to negative voltage lead 32, this in addition to appropriate mounting of the ionizing element 29 within the unit. Accordingly, a high negative pulsating DC voltage appears at the head of the needle or elongated element 30. This produces a pulsating electrostatic field which proceeds through the front grill member 24A into a substantial part of the room interior. Such pulsating, negative, electrostatic field electrically charges negatively, and in some instances ionizes negative the air constituents of the room interior subjected to such electrostatic field. In addition, and combined with this effect, air constituents, e.g. air molecules proximate the ionizing needle are also ionized and/or negatively charged, which of course may also include particulates, lint, dust, smoke and the like, which have not been captured by the intake filter of unit 24. An important feature of the invention is that substantially all of these particulates will simply drop out of their otherwise entrained state in the ambient air and simply fall to the floor. There the precipitated dust, lint, smoke particles and so forth, may simply be swept up using a vacuum.

It has been found that the unit will work well even without the blower; however, the blower unit and its fan augment the ionization process and the precipitation of foreign matter which results.

It is noted that there is no corona discharge that is required; rather, the ionizing element, rather than having precipitation collecting plates and the like, is actually shielded, to avoid electron-flow leakage, from the interior workings of the unit so that in addition to the ionized air molecules produced at the needle, there is likewise produced a pulsating and progressively expanding electrostatic field that serves to charge air particulates negatively and thus causes these to precipitate out of the ambient air toward the floor.

What is provided therefore is a new and improved unit for cleaning ambient air, and this such that noxious products such as nitrogen oxide and ozone are not produced. Furthermore, dust collecting plates of opposite charge and similar structure are avoided.

What the present invention provides therefore is a new and improved unit comprising ionizing structure suitable for conditioning and improving ambient air in a manner to precipitate out of the ambient air smoke particles, dust, lint and other particulates, this rendering the atmosphere pleasing to occupants of the room incorporating the device.

While particular advantages have been shown and described, it will be obvious to those skilled in the art that various changes and modifications may be made without departing from the aspect of this invention and therefore, the aim in the appended claims is to cover all such changes and modifications as fall within the true spirit and scope of the invention.

I claim:

1. Ionizing structure for ambient air treatment including, in combination: a housing having an air inlet provided with a filter unit; an air outlet provided a perforate grill; a blower mounted within said housing proximate said filter unit; an ionizing element disposed forwardly of said blower and comprising an elongated, forwardly pointing needle element and a rearward head integral therewith; an insulative cover mount supported within said housing, having a pocket receiving said head, and provided with a forwardly open interior centrally receiving said needle element; means for electrically powering said blower; and means for electrically charging negatively said needle element whereby to cause said needle element to create negative air-constituent ions advanceable by said blower and also to create a forwardly projecting electrostatic field, whereby to negatively charge and precipitate out from ambient air any particulates entrained therein.

2. In combination, structure including a housing provided with an interior ionizing element comprising thumbtack-shaped member having a head and an ionizing elongated element projecting forwardly of said head and integral therewith, a post upstanding from said housing and supporting said head, an insulative cover mount constructed to secure said head against said post and provide a hollow interior for receiving said ionizing elongated element, and first means coupled to said head for providing a negative voltage thereto, said cover mount being constructed and arranged for positioning said elongated element in a desired location within said housing.

3. Ionizing structure for ambient air treatment including, in combination: a housing having an air inlet provided with a filter unit; an air outlet provided a perforate grill; a blower mounted within said housing proximate said filter unit; an ionizing element disposed forwardly of said blower and comprizinq an elongated, forwardly pointing needle element and a rearward head integral therewith; an insulative cover mount supported within said housing, having a pocket receiving said head, and provided with a forwardly open interior centrally receiving said needle element; means for electrically powering said blower; means for electrically charging negatively said needle element whereby to cause said needle element to create negative air-constituent ions advanceable by said blower and also to create a forwardly projecting electrostatic field, whereby to negatively charge and prepcipitate out from ambient air any particulates entrained therein, and wherein said structure is also provided with a cylindrical, upstanding riser post, and a cover mount provided with lower cylindrical segments fitted into said riser post, said cover mount also being provided with interior structure defining a pocket for receiving said head and coacting with said riser post for mounting said ionizing element essentially coaxial with and interior of said cover mount, whereby to direct electrostatic field generation forwardly of said elongated element and cover mount, and electrical means coupled to said head for applying a negative potential to said elongated element whereby to ionize ambient air molecules and also to generate a forwardly projecting electrostatic field for negatively charging entrained particulates in room air.

4. The combination of claim 3 wherein said electrical means comprises means for applying a pulsating negative potential to said elongated element, whereby to ionize ambient air molecules and also to generate a forwardly projecting, pulsating electrostatic field for negatively charging entrained particulates in room air.

5. In combination, an air ionizing element comprising an electrically conductive thumbtack-shaped member having a head and an elongated element integral therewith, electrical connector means coupled to said head for supplying a negative potential thereto, and a mounting member having a pocket receiving said head and provided with a first open-ended slot for receiving said electrical connector means and a second open-ended slot for receiving said elongated element.

6. In combination, a support-and-shield insulative member having a top, opposite sides integral with said top and forming an ionizing element receiving chamber, a rear panel integral with said top and opposite sides, and an intermediate partition integral with said sides, spaced from said rear panel and forming an ionizing element head-receiving pocket, said intermediate partition having an accessible open-ended slot to receive an ionizing element; and an ionizing element having a needle releasably inserted into said slot and a head integral with said needle and releasably positioned in said head-receiving pocket.

7. In combination, structure having a cylindrically tubular upstanding support post, a support-and-shield insulative member having an open interior and depending cylindrical sector elements releasably mounted within said cylindrical support post, and an ionizing element forwardly mounted centrally within said insulative member and seated on said support post, being retained thereon by said insulative member, said ionizing element comprising a transverse head disposed between selected ones of said sector elements and a needle integral with and axially extending forwardly with respect to said head.

* * * * *